US005993177A

United States Patent [19]

Terauchi et al.

[11] Patent Number: 5,993,177

[45] Date of Patent: Nov. 30, 1999

[54] SCROLL TYPE COMPRESSOR WITH IMPROVED VARIABLE DISPLACEMENT MECHANISM

[75] Inventors: Kiyoshi Terauchi, Isesaki; Shigemi Shimizu; Akiyoshi Higashiyama, both of Sawa-gun; Akihiro Kawano, Maebashi, all of Japan

[73] Assignee: Sanden Corporation, Gunma, Japan

[21] Appl. No.: 08/858,465

[22] Filed: May 19, 1997

[30] Foreign Application Priority Data

May 21, 1996 [JP] Japan ..... 8-125322

[51] Int. Cl.[6] ..... F04B 49/00

[52] U.S. Cl. ..... 417/440; 417/308; 417/310

[58] Field of Search ..... 417/310, 308, 417/299, 440; 137/540, 366

[56] References Cited

U.S. PATENT DOCUMENTS

| | | | |
|---|---|---|---|
| 4,715,792 | 12/1987 | Nishizawa et al. | 417/295 |
| 4,904,164 | 2/1990 | Mabe et al. | 417/308 |
| 5,074,760 | 12/1991 | Hirooka et al. | 417/310 |
| 5,074,761 | 12/1991 | Hirooka et al. | 417/310 |
| 5,240,388 | 8/1993 | Matsumoto et al. | 417/299 |
| 5,397,219 | 3/1995 | Cretors | 417/299 |
| 5,451,146 | 9/1995 | Inagaki et aal. | 417/310 |
| 5,547,349 | 8/1996 | Kimura et al. | 417/282 |
| 5,591,014 | 1/1997 | Wallis et al. | 417/310 |
| 5,759,013 | 6/1998 | Miyazaki et al. | 417/310 |

FOREIGN PATENT DOCUMENTS

| | | |
|---|---|---|
| 0354867 | 2/1990 | European Pat. Off. . |
| 1162094 | 11/1989 | Japan . |
| 5280476 | 10/1993 | Japan . |

*Primary Examiner*—Charles G. Freay
*Assistant Examiner*—Robert Z. Evora
*Attorney, Agent, or Firm*—Baker & Botts, L.L.P.

[57] ABSTRACT

In a scroll type compressor wherein a fixed scroll (8) has an end plate (8*b*) and an involute vane (8*a*) fixed to the end plate and is coupled to a movable scroll (5) so as to define a pair of working spaces therebetween, the end plate of the fixed scroll are formed a pair of cylinders each of which communicates with the working spaces via bypass holes (15*a*) and (15*b*) formed in the end plate of the fixed scroll. In each of the cylinders, a cylindrical piston valve member (10) is slidably received for opening and closing the bypass holes. Opening or closing of each bypass hole is determined depending on a position of an axial end of the piston valve member relative to the corresponding bypass hole.

8 Claims, 2 Drawing Sheets

SCROLL TYPE COMPRESSOR WITH IMPROVED VARIABLE DISPLACEMENT MECHANISM

BACKGROUND OF THE INVENTION

The present invention relates to a variable displacement scroll type compressor to be used, for example, as a refrigerant compressor for an automobile air conditioner and, in particular, to a variable displacement mechanism of a scroll type compressor.

Variable displacement mechanisms of scroll type compressors are disclosed in, for example, Japanese First (unexamined) Utility Model Publication No. 1-162094 and Japanese First (unexamined) Patent Publication No. 5-280476.

In the former publication, a pair of cylinders each communicating with bypass holes are provided in an end plate of a fixed scroll, and a hollow valve member is slidably-received in each of the cylinders for opening and closing the bypass holes. Opening of the innermost bypass hole is achieved by moving the valve member to a position where a hole formed at an intermediate portion of the valve member coincides with the innermost bypass hole. When the innermost bypass hole is opened, refrigerant gas is relieved to the suction side through the innermost bypass hole, the valve member hole and the hollow inside of the valve member.

On the other hand, in the latter publication, one cylinder communicating with bypass holes is provided in an end plate of a fixed scroll, and a valve member is slidably received in the cylinder for opening and closing the bypass holes. Opening of the innermost bypass hole is achieved by moving the valve member to an innermost position in the cylinder so as to pass the innermost bypass hole.

In the former publication, a diameter of the cylinder is required to be the sum of a diameter of the hollow inside of the valve member and thicknesses of the walls of the valve member. Further, it is possible that the valve member rotates in the cylinder so that the coincidence of the innermost bypass hole and the valve member hole is not guaranteed. Considering the rotation of the valve member, an annular groove communicating with the valve member hole may be necessary on the outer circumference of the valve member. Provision of the annular groove increases thicknesses of the walls of the valve member and thus a diameter of the valve member to thereby increase a diameter of the cylinder. Accordingly, the thickness of the end plate of the fixed scroll is increased to further increase the axial length and the weight of the compressor.

On the other hand, in the latter publication, only one cylinder is provided for relieving the refrigerant gas via the bypass holes while a pair of crescent-shaped sealed working spaces are formed as pressure chambers. Thus, the flow rate of the refrigerant gas through the cylinder is large to cause a large pressure loss. For lowering the required power during the reduced displacement operation of the compressor, it is necessary to reduce the pressure loss at the cylinder and thus design the cylinder with a larger bore. Accordingly, like the former publication, the thickness of the end plate of the fixed scroll is increased to further increase the axial length and the weight of the compressor.

SUMMARY OF THE INVENTION

It is therefore an object of the present invention to provide an improved variable displacement scroll type compressor which can be small in axial length and weight with a smaller thickness of an end plate of a fixed scroll.

Other objects of this invention will become clear as the description proceeds.

According to one aspect of the present invention, there is provided a scroll type compressor comprising a fixed scroll having an end plate and an involute vane extending along a principal surface of the end plate around a predetermined axis perpendicular to the principal surface, the end plate being formed with a pair of cylinders extending parallel to the principal surface at both sides of the predetermined axis, respectively, and with a pair of bypass holes communicating the cylinders with the principal surface, each of the cylinders being communicated with a suction chamber, a pair of valve members slidably received in the cylinders, respectively, each of the valve members determining opening or closing of the corresponding bypass hole depending on a relative position between one end of each of the valve members and the corresponding bypass hole, a movable scroll coupled to the fixed scroll for defining a pair of working spaces in cooperation with the principal surface and the involute vane, the working spaces being placed at both sides of the predetermined axis, respectively, and being introduced with fluid from the suction chamber, scroll driving means connected to the movable scroll for driving the movable scroll to reduce each of the working spaces with movement of the working spaces along the involute vane towards the predetermined axis; and valve displacing means operatively connected to the valve members for displacing the valve members in the cylinders.

According to another aspect of the present invention, there is provided a scroll type compressor comprising a fixed scroll having an end plate and an involute vane fixed thereto, a movable scroll having an end plate and an involute vane fixed thereto, the movable scroll engaging with the fixed scroll to define therebetween a pair of working spaces into which fluid is introduced from a suction chamber to be compressed, a pair of cylinders provided in the end plate of the fixed scroll, each of the cylinders open to the suction chamber at its open end, a pair of bypass holes provided in the end plate of the fixed scroll corresponding to each of the cylinders so that each of the cylinders communicates with the working chambers through the bypass holes, and a pair of valve members each slidably received in the corresponding one of the cylinders, each of the valve members being movable toward the other end of the corresponding cylinder opposite to the open end of the corresponding cylinder until one end of the valve member located at the open end of the corresponding cylinder passes the bypass holes, and opening or closing of each of the bypass holes is determined depending on a position of the one end of the corresponding valve member relative to the corresponding bypass hole.

DESCRIPTION OF THE PREFERRED EMBODIMENT

Figure 1:
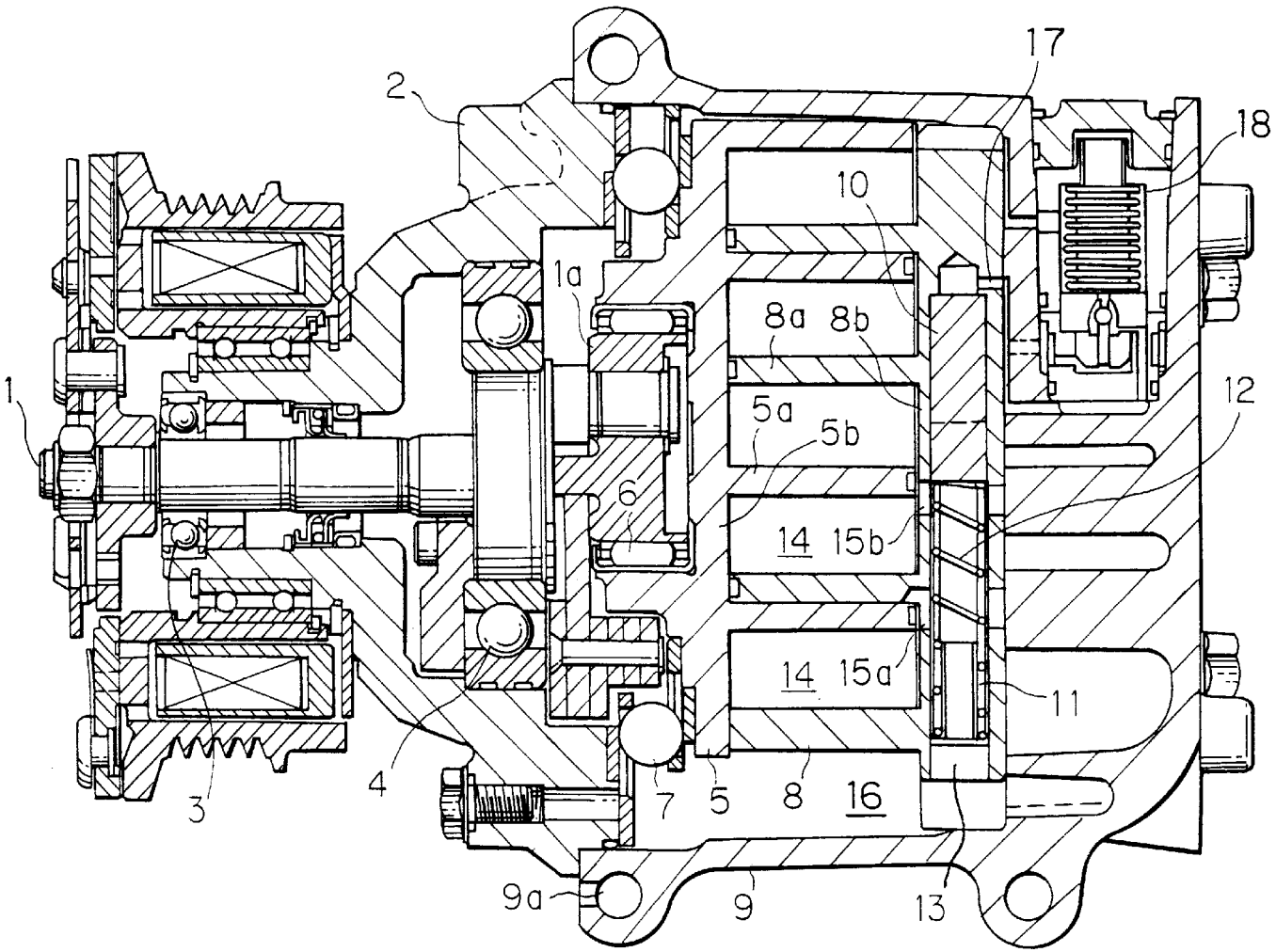
FIG. 1 is a sectional view of a variable displacement scroll type compressor according to a preferred embodiment of the present invention.
Figure 2:
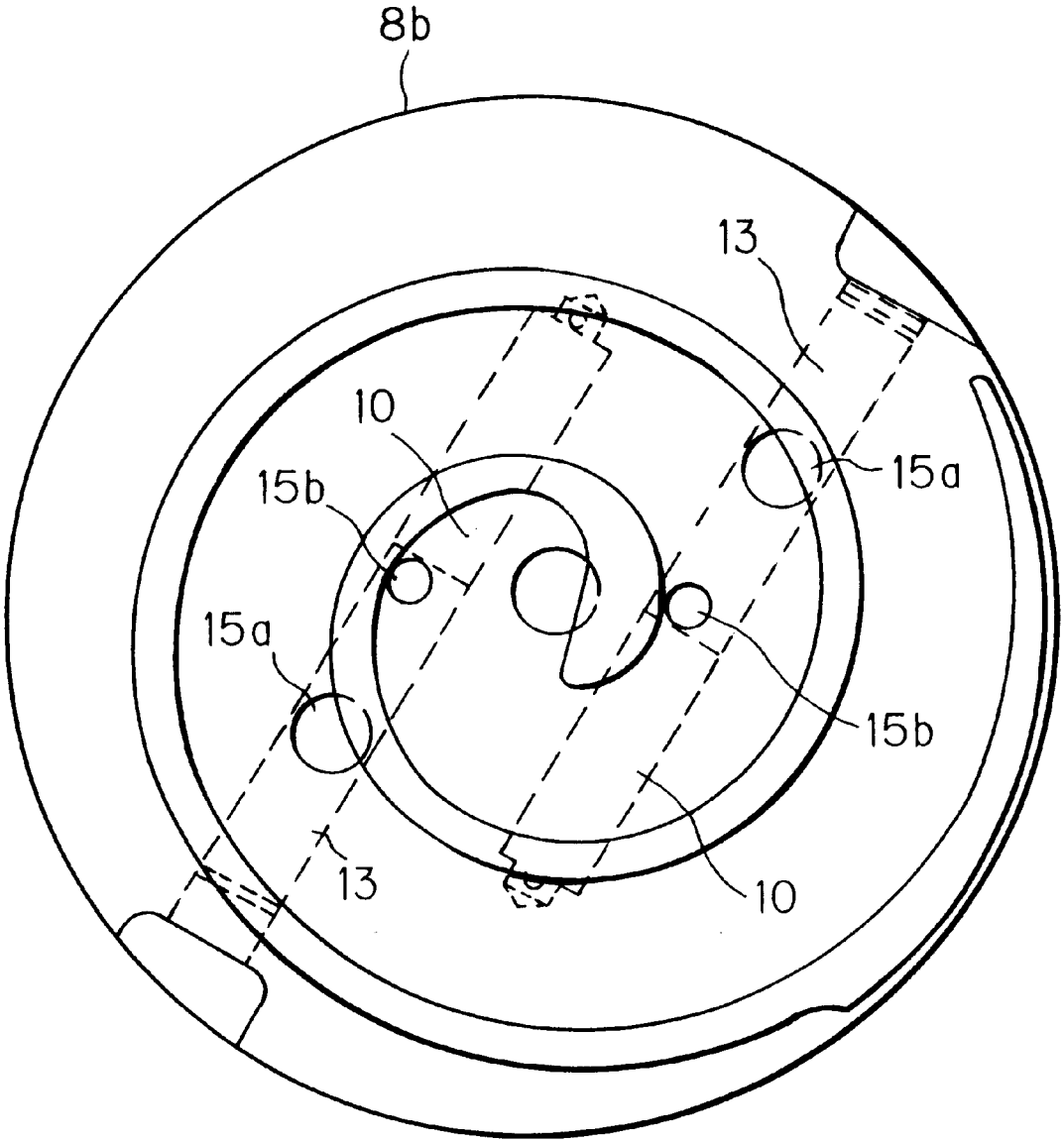
FIG. 2 is a plan view of a fixed scroll of the compressor shown in FIG. 1.

Referring to FIGS. 1 and 2, description will be made as regards a scroll type compressor according to an embodiment of the present invention.

In the figures, numeral 1 denotes a drive shaft having a crank portion 1*a*. Numeral 2 denotes a funnel-shaped front housing rotatably supporting the drive shaft 1 via bearings 3 and 4. Numeral 5 denotes a movable scroll having an involute vane (spiral wall) 5*a* with substantially about 2.5 turns and a circular end plate 5*b* which are formed integral with each other. The movable scroll 5 is rotatably coupled to the crank portion 1*a* of the drive shaft 1 via a needle bearing 6. Further, between the movable scroll 5 and the front housing 2 is provided a so-called rotation preventing mechanism in the form of combination of a plurality of balls 7 and corresponding circular grooves.

Numeral 8 denotes a fixed scroll having, like the movable scroll 5, an involute vane (spiral wall) 8*a* with substantially about 2.5 turns and a circular end plate 8*b* which are formed integral with each other. The involute vane 8*a* extends along a principal surface of the circular end plate 8*b* around a predetermined axis perpendicular to the principal surface. Numeral 9 denotes a cup-shaped casing or rear housing defining therein a suction chamber 16 and having inlet and outlet ports (not shown). The casing 9 is fixed by bolts (not shown) inserted into bolt insertion holes 9*a*, along with the front housing 2 and the fixed scroll 8.

When the drive shaft 1 is rotated, the movable scroll 5 makes an orbital motion with no rotation on its axis. During the orbital motion of the movable scroll 5, the refrigerant gas in the suction chamber 16 is trapped in a plurality of sealed working spaces 14 defined by the involute vanes 8*a*, 5*a* of the fixed and movable scrolls 8, 5, and then the working spaces 14 move along the involute vane 8*a* towards the predetermined axis while reducing their volumes to achieve compression of the trapped refrigerant gas. The drive shaft 1 is referred to as a scroll driving arrangement.

The compressor has a variable displacement mechanism which is incorporated in the end plate 8*b* of the fixed scroll 8 and comprises a pair of piston valve members 10. Each of the piston valve members 10 is solid and cylindrical. The piston valve members 10 are slidably received in corresponding cylinders 13 formed in the end plate 8*b* of the fixed scroll 8, respectively. Each cylinder 13 communicates with the working spaces 14 via first and second bypass holes 15*a* and 15*b* which are formed in the end plate 8*b* of the fixed scroll 8 to extend between each cylinder 13 and the principal surface of the end plate 8*b*. Each cylinder 13 opens to the suction chamber 16 at an peripheral surface of the end plate 8*b*.

The description will be proceeded as regards only one of the piston valve members 10. When the piston valve member 10 moves toward the open side of the cylinder 13 from the position shown in FIGS. 1 and 2 where the bypass holes 15*a* and 15*b* are both opened, the bypass holes 15*b* and 15*a* are closed in order by the piston valve member 10. The piston valve member 10 is arranged to be movable toward an innermost side of the cylinder 13 opposite to the open side thereof until one axial end of the piston valve member 10 located at the open side of the cylinder 13 passes the bypass hole 15*b*. Accordingly, opening or closing of each bypass hole 15*a* and 15*b* is determined depending on a position of the foregoing axial end of the piston valve member 10 relative to the corresponding bypass hole 15*a* or 15*b*.

Numeral 11 denotes a small-diameter cylindrical valve stopper fixed at the open side of the cylinder 13 for regulating a stroke of the piston valve member 10 within the cylinder 13 to a given value. A coil spring 12 is made of a spring member and is disposed between the valve stopper 11 and the piston valve member 10 so as to bias the piston valve member 10 to the innermost side of the cylinder 13, that is, to the position shown in FIGS. 1 and 2 where the bypass holes 15*a* and 15*b* are both opened.

The innermost side of the cylinder 13 is connected to the suction chamber 16 through a pressure transmitting path 17 and a pressure control mechanism 18 which is inserted in the pressure transmitting path 17. The pressure control mechanism 18 is for controlling pressure of the innermost side of the cylinder 13 in response to pressure of the suction chamber 16 in the manner known in the art.

The pressure of the innermost side of the cylinder 13 urges the piston valve member 10 towards a predetermined direction in the cylinder. On the other hand, the spring 12 urges the piston valve member 10 against the predetermined direction. A combination of the pressure transmitting path 17 and the pressure control mechanism 18 is referred to as a first urging arrangement. The spring 12 is referred to as a second urging arrangement.

In the variable displacement scroll type compressor thus structured, the compression is not effected while the piston valve member 10 is located at the innermost side of the cylinder 13, that is, at the position where the bypass holes 15*a* and 15*b* are both opened. On the other hand, by moving the piston valve member 10 toward the open side of the cylinder 13 to close the bypass holes 15*b* and 15*a* in order, the number of the working spaces increases in sequence to increase the capacity of the compressor. In this event, the second bypass hole 15*b* may be referred to as an addition bypass hole having a size which is smaller than that of each of the first bypass holes 15*a*.

In the foregoing preferred embodiment, the cylinders 13 forming the variable displacement mechanism are formed in the end plate 8*b* of the fixed scroll 8 so as to lessen the axial length of the compressor. However, the present invention is not limited to such a structure, but also applicable to a structure where separately prepared cylinders are fixed to the surface of the end plate 8*b*.

As described above, since opening or closing of each of the bypass holes 15*a* or 15*b* is determined depending on a position of the axial end of the piston valve member 10 relative to the corresponding bypass hole, it is not necessary to form the piston valve member 10 to be hollow. Further, since the cylinders 13 are provided in pair, the pressure loss can be reduced even if the diameter of each cylinder 13 is small. Accordingly, the diameter of each piston valve member 10 and thus the diameter of each cylinder 13 can be reduced. This can reduce the thickness of the end plate 8*b* of the fixed scroll 8 so as to provide the compressor with the reduced axial length, size and weight.

Further, by forming the piston valve member 10 to be solid and cylindrical, the piston valve member 10 can be easily processed to achieve lowering of the processing cost.

While the present invention has thus far been described in connection with a single embodiment thereof, it will readily be possible for those skilled in the art to put this invention into practice in various other manner. For example, the end plate of the fixed scroll is formed with three or more bypass holes.

What is claimed is:

1. A scroll compressor comprising:

a fixed scroll comprising:

an end plate having a principal surface;

a first involute vane extending along the principal surface of said end plate around a predetermined axis perpendicular to said principal surface;

a first cylinder and a second cylinder formed within said end plate and extending parallel to said principal surface on a first side and a second side of said predetermined axis, respectively, said first and second cylinder communicating with a suction chamber; and, a first bypass hole and a second bypass hole, said first and second bypass hole providing communication between said first cylinder and said principal surface and said second cylinder and said principal surface, respectively;

a first solid cylindrical valve member having a first and second end slidably received in the first cylinder and a second solid cylindrical valve member slidably received in the second cylinder, the second end of the first and second solid cylindrical valve members operatively opens and closes the first and second bypass holes respectively, depending on a relative position of the first and second solid cylindrical valve members within the first and second cylinders;

a movable scroll coupled to said fixed scroll and defining a first and a second working space in cooperation with said principal surface and said involute vane, said first and second working spaces being disposed on a first and a second side of said predetermined axis, respectively, wherein said first and second working spaces are introduced with fluid from said suction chamber;

scroll driving means connected to said movable scroll for driving said movable scroll to move said first and second working spaces along said involute vane towards said predetermined axis and thereby reduce a volume of said first and second working spaces; and, valve displacing means operatively connected to said first and second solid cylindrical valve members for displacing said first and second solid cylindrical valve members in said first and second cylinders, respectively.

2. A scroll compressor as claimed in claim 1, wherein said valve displacing means comprises:

first urging means operatively connected to said suction chamber and said first and second solid cylindrical valve members for urging said first and second solid cylindrical valve members in a first direction and a second direction, respectively in said cylinders in response to pressure in said suction chamber; and, second urging means operatively connected to said first and second solid cylindrical valve members for urging said first and second solid cylindrical valve members in a third direction and a fourth direction, respectively, said third direction being opposite to said first direction and said fourth direction being opposite to said second direction.

3. A scroll compressor as claimed in claim 2, wherein said second urging means comprises a first and a second coil spring disposed in said first and second cylinders, respectively.

4. A scroll compressor as claimed in claim 2, further comprising a first valve stopper and a second valve stopper disposed within said first and second cylinders, respectively, said first and second valve stoppers operative to restrict movement of said first and second solid cylindrical valve members in said first and second directions.

5. A scroll compressor as claimed in claim 1, wherein said end plate further comprises a third bypass hole and a fourth bypass hole, said third and fourth bypass holes providing communication between said first cylinder and said principal surface and said second cylinder and said principal surface, respectively.

6. A scroll compressor as claimed in claim 5, wherein said third bypass hole is offset from said first bypass hole in a first direction and said fourth bypass hole is offset from said second bypass hole in a second direction.

7. A scroll type compressor as claimed in claim 5, wherein said third bypass hole has a size that is different from a size of said first bypass hole and said fourth bypass hole has a size that is different from a size of said second bypass hole.

8. A scroll compressor comprising:

a fixed scroll comprising a first end plate and a first involute vane fixed to the first end plate;

a movable scroll comprising a second end plate and a second involute vane fixed to the second end plate, said movable scroll engaging with said fixed scroll to define a pair of working spaces into which fluid to be compressed is introduced from a suction chamber;

a first cylinder and a second cylinder provided in the first end plate, said first and second cylinders having an open end that communicates with said suction chamber;

a first bypass hole and a second bypass hole provided in the first cylinder and the second cylinder of the first end plate, respectively, and said first and second bypass holes providing communication between said first and second cylinders and said working spaces;

a first solid cylindrical valve member and a second solid cylindrical valve member having a first and second end slidably received in the first cylinder and the second cylinder, respectively, wherein said second end of said first solid cylindrical valve member and said second end of said second solid cylindrical valve member are movable within said first and second cylinders and are operative to open and close said first bypass hole and said second bypass hole, respectively depending on a position of said first and second solid cylindrical valve member relative to the corresponding bypass hole.

* * * * *